US009345337B1

(12) United States Patent
Chai

(10) Patent No.: US 9,345,337 B1
(45) Date of Patent: May 24, 2016

(54) MATTRESS PROTECTOR

(71) Applicant: Swo-Chung Chai, Taipei (TW)

(72) Inventor: Swo-Chung Chai, Taipei (TW)

( * ) Notice: Subject to any disclaimer, the term of this patent is extended or adjusted under 35 U.S.C. 154(b) by 0 days.

(21) Appl. No.: 14/754,842

(22) Filed: Jun. 30, 2015

(51) Int. Cl.
*A47G 9/00* (2006.01)
*A47C 31/10* (2006.01)
*A47G 9/04* (2006.01)

(52) U.S. Cl.
CPC ..... *A47C 31/105* (2013.01); *A47G 9/04* (2013.01)

(58) Field of Classification Search
CPC .. A47C 31/105; A47C 27/002; A47C 27/005; A47C 27/006; A47C 27/007; A47G 9/04
See application file for complete search history.

(56) References Cited

U.S. PATENT DOCUMENTS 3,956,782 A * 5/1976 Morrison ..... A47C 27/005 248/647
5,910,081 A * 6/1999 Graham ..... A47C 31/105 5/699
2002/0148047 A1* 10/2002 Corzani ..... A47C 27/006 5/738
2007/0199155 A1* 8/2007 Thygsen ..... A47C 31/105 5/737
2007/0251017 A1* 11/2007 Speer ..... A47C 27/005 5/737
2010/0306923 A1* 12/2010 Navan ..... A47G 9/0207 5/652.1
2012/0084918 A1* 4/2012 Rattner ..... A47C 31/105 5/500
2012/0167302 A1* 7/2012 Malouf ..... A47C 31/007 5/484
2012/0255120 A1* 10/2012 Poston ..... A47C 31/105 5/499
2012/0276798 A1* 11/2012 Chai ..... B32B 27/12 442/394
2013/0042409 A1* 2/2013 Gil Gomez ..... A47G 9/0246 5/487
2015/0026895 A1* 1/2015 Geelen ..... A47C 27/001 5/699
2015/0096120 A1* 4/2015 Scarleski ..... A47C 21/028 5/484
2015/0096121 A1* 4/2015 Scarleski ..... A47C 21/028 5/484
2015/0096126 A1* 4/2015 Chai ..... A47C 27/081 5/706

* cited by examiner

*Primary Examiner* — David E Sosnowski
(74) *Attorney, Agent, or Firm* — Rosenberg, Klein & Lee

(57) ABSTRACT

A mattress protector includes upper and lower central portions connected respectively to an upper end and a lower end of a peripheral portion. Each of the upper and lower central portions has a TPU lining layer on the inner side. The peripheral portion has a TPU lining layer on the inner side and a PU shell layer on the outer side. The peripheral portion also has a waterproof zipper in its middle section. The contact areas of the two central portions and of the peripheral portion are connected together by a laminator through a hot pressing process to form the hollow mattress protector. The TPU lining layers on the inner side of the mattress protector are fused together to form a sealed and gap-free inner structure.

2 Claims, 5 Drawing Sheets

MATTRESS PROTECTOR

BACKGROUND OF THE INVENTION

1. Technical Field

The present invention relates to a mattress protector and more particularly to a new-generation, improved mattress protector which is designed specifically for the care of patients, capable of effectively preventing liquid seepage, and easy to clean.

2. Description of Related Art

The conventional mattress protectors, such as those for household use, are typically made of woven fabric and serve mainly to receive and enclose the mattress to be protected. When such a mattress protector is soiled on the outside, it can be readily removed from the mattress, washed, and then used again to ensure that the generally bulky and difficult-to-wash mattress is always clean, hygienic, and good for use.

However, a mattress protector made of woven fabric is not waterproof. Should a liquid seep through the mattress protector to the mattress received therein, the mattress may be contaminated, become odorous, or even end up useless due to damage to its internal structure. This kind of mattress protectors, therefore, are not suitable for use where they are expected to block seepage and prevent mattress contamination. For example, they are not advised for use with the mattress on a hospital bed, a surgical bed, or the like.

To solve the seepage problem, some conventional mattress protectors are made of waterproof woven fabric to keep liquids from seeping to the mattress being protected, but since these mattress protectors are generally manufactured by sewing (e.g., the contact areas of the top portion and of the peripheral portion of such a mattress protector are sewn together), the tiny gaps in the seams allow seepage to occur.

While seepage through the seams can be prevented by blocking the gaps in the seams with an adhesive substance or adhesive strip, there are obvious disadvantages with the application of an adhesive substance or adhesive strip. More particularly, an adhesive substance tends to age and deteriorate, and an adhesive strip may peel off while the mattress protector to which it is applied is being washed. This kind of mattress protectors not only increase the man-hour cost of production, but also have short service lives because of the adhesive substance or adhesive strip.

BRIEF SUMMARY OF THE INVENTION

In view of the above, and in order to overcome the aforesaid drawbacks and inconveniences of the prior art, the present invention provides a mattress protector which is designed specifically for the care of patients, capable of effectively preventing liquid seepage, and easy to clean.

To achieve the foregoing objective, the present invention adopts the following technical solutions:

The mattress protector of the present invention includes a peripheral portion and a central portion connected to each of an upper end and a lower end of the peripheral portion.

The upper and lower central portions are of the same structure.

Each central portion includes a woven-fabric base layer and a TPU (thermoplastic polyurethane) lining layer provided on an inner side of the woven-fabric base layer, wherein the woven-fabric base layer and the TPU lining layer are connected together by a laminator through a hot pressing process.

The peripheral portion includes a woven-fabric base layer, a TPU lining layer provided on an inner side of the woven-fabric base layer, and a PU (polyurethane) shell layer provided on an outer side of the woven-fabric base layer, wherein the woven-fabric base layer, the TPU lining layer, and the PQ shell layer are connected together by a laminator through a hot pressing process.

In addition, the peripheral portion has a middle section provided with a waterproof zipper.

To manufacture the mattress protector, the two central portions are placed at the upper and lower ends of the peripheral portion respectively, and the contact areas of the two central portions and of the peripheral portion are connected together by a laminator through a hot pressing process such that a hollow mattress protector is formed.

Thanks to their woven-fabric base layers, the peripheral portion and the upper and lower central portions have a low elongation rate and high tensile strength and feel comfortable to the touch.

The TPU lining layers on the inner sides of the upper and lower central portions and of the peripheral portion are fused together by the hot pressing process used to connect the aforesaid contact areas, thus forming a sealed and gap-free inner structure on the inner side of the mattress protector. This inner structure features waterproofness and seepage prevention.

When the waterproof zipper is opened, a mattress can be put into the mattress protector in order for the sealed and gap-free inner structure formed by the TPU lining layers to enclose the mattress and effectively prevent liquids from seeping to the mattress.

The mattress protector can be removed from the mattress whenever desired and is reusable after being washed clean. Thus, the aforesaid objective of the present invention is achieved.

BRIEF DESCRIPTION OF THE SEVERAL VIEWS OF THE DRAWINGS

The structure of an illustrative embodiment of the present invention is detailed below with reference to the accompanying drawings, in which.

DETAILED DESCRIPTION OF THE INVENTION

Figure 1:
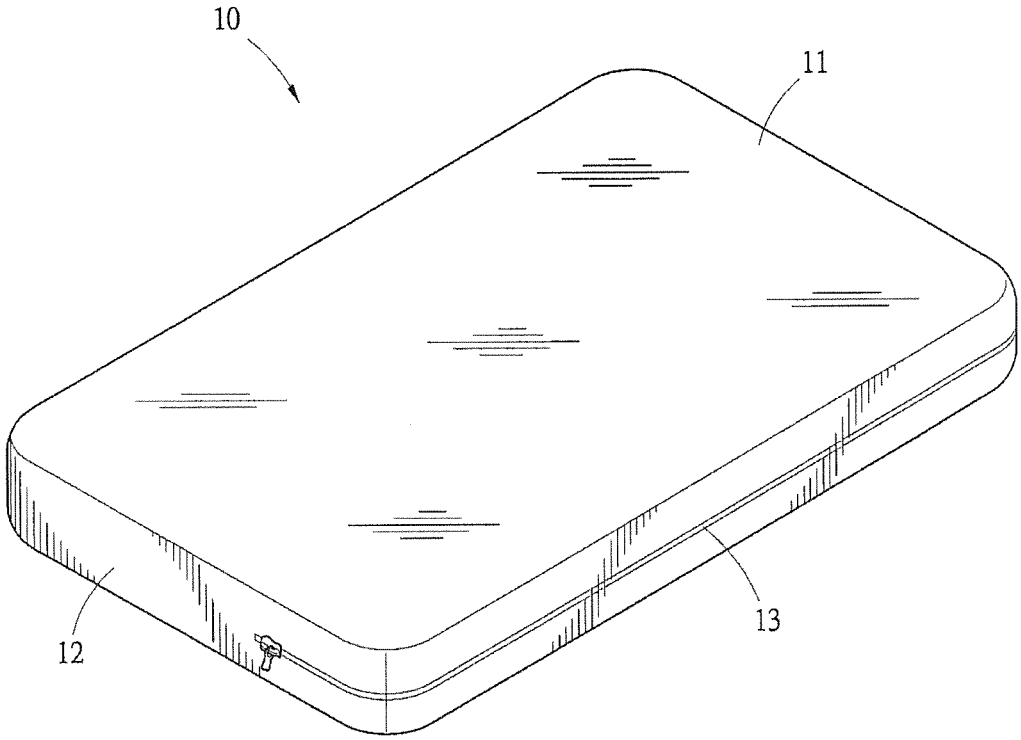
FIG. 1 is a perspective view of a mattress protector according to the present invention.

FIG. 1 is a perspective view of the mattress protector 10 in an embodiment of the present invention.

Figure 2:
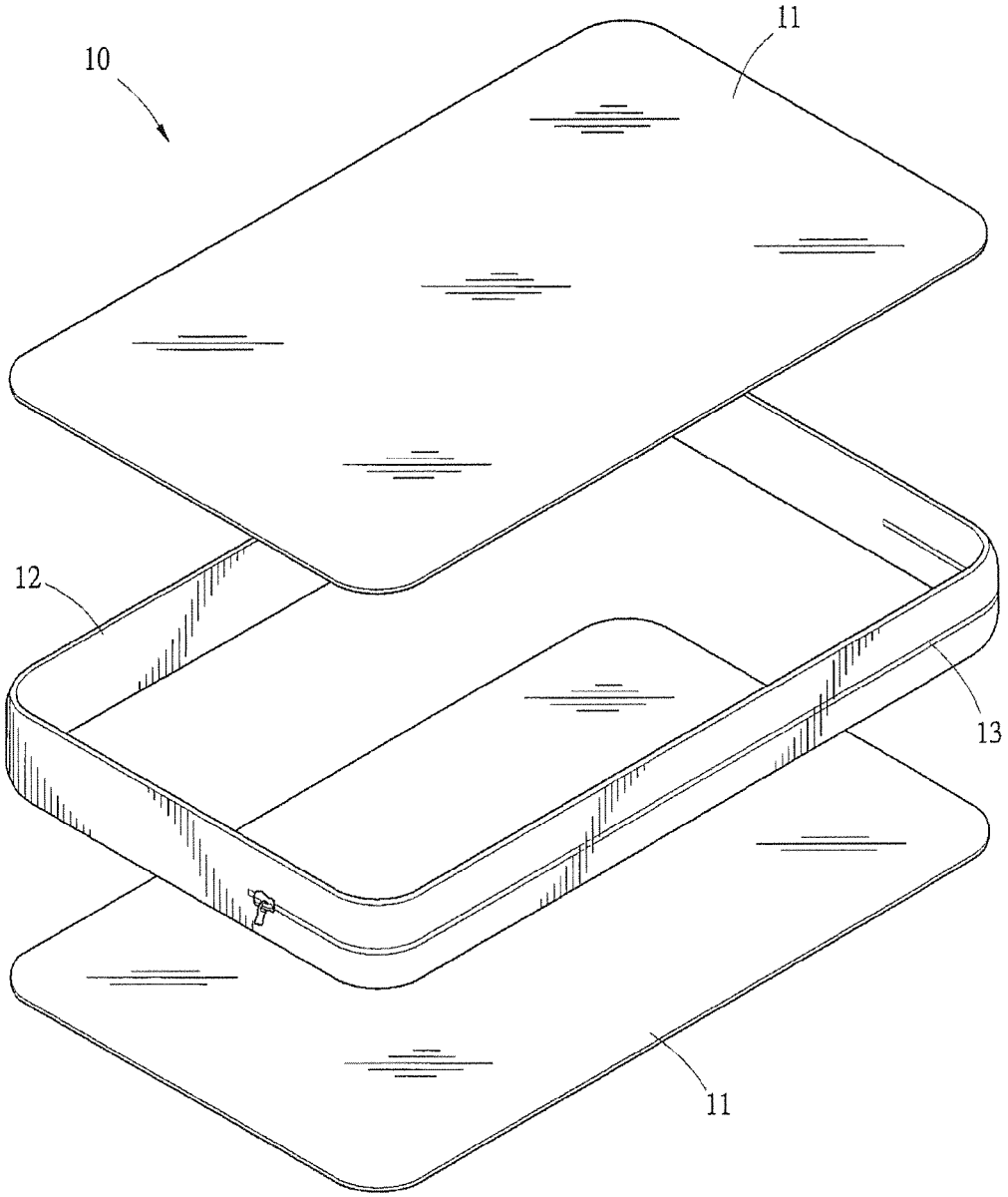
FIG. 2 is an exploded view of the mattress protector in FIG. 1.

FIG. 2 is an exploded view of the mattress protector 10.

As shown in FIG. 1 and FIG. 2, the mattress protector 10 includes a peripheral portion 12 and two central portions 11. The central portions 11 are connected to an upper end and a lower end of the peripheral portion 12 respectively.

The upper and lower central portions 11 have the same structure.

Figure 3:
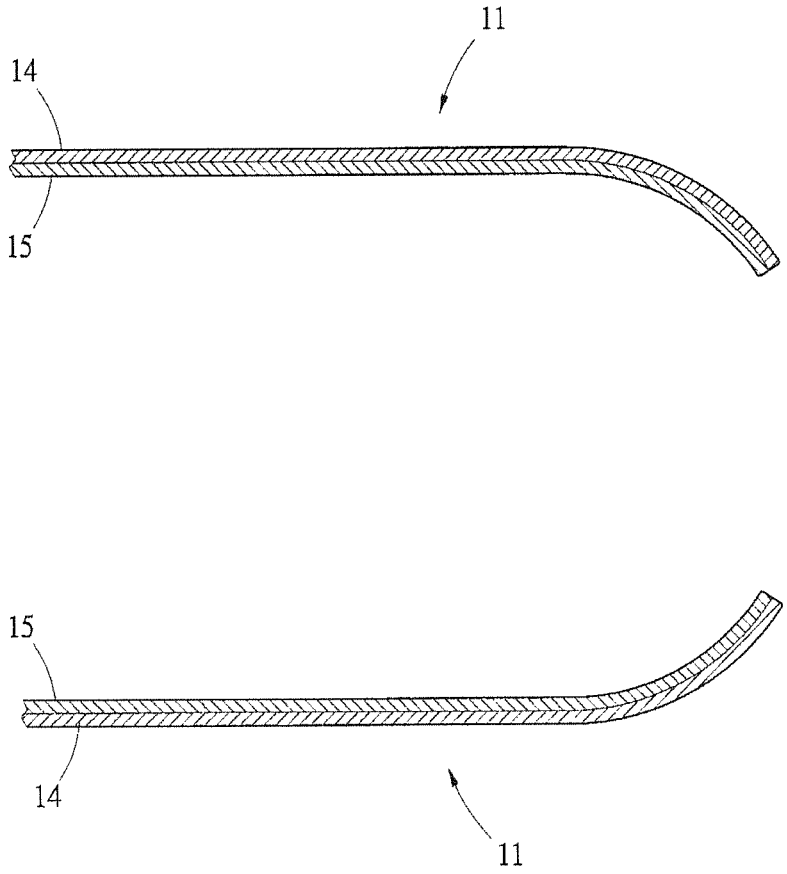
FIG. 3 is a sectional view of the central portions of the mattress protector in FIG. 1.

Referring to FIG. 3 in conjunction with FIG. 2, each central portion 11 includes a woven-fabric base layer 14 and a TPU (thermoplastic polyurethane) lining layer 15 provided on an inner side of the woven-fabric base layer 14, wherein the woven-fabric base layer 14 and the TPU lining layer 15 are connected together by a laminator through a hot pressing process.

Figure 4:
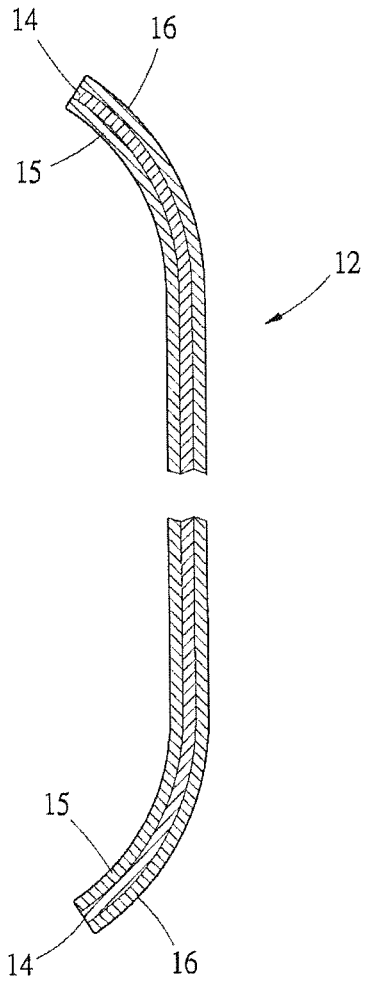
FIG. 4 is a sectional view of the peripheral portion of the mattress protector in FIG. 1.

Referring to FIG. 4 in conjunction with FIG. 2, the peripheral portion 12 includes a woven-fabric base layer 14, a TPU lining layer 15 provided on an inner side of the woven-fabric base layer 14, and a PU (polyurethane) shell layer 16 provided on an outer side of the woven-fabric base layer 14, wherein the woven-fabric base layer 14, the TPU lining layer 15, and the PD shell layer 16 are connected together by a laminator through a hot pressing process.

In addition, referring again to FIG. 2, the peripheral portion 12 has a middle section provided with a waterproof zipper 13.

The waterproof zipper 13 is commercially available and features waterproofness and seepage prevention. The waterproof zipper 13 has two sides which can be opened with respect to each other and which are each provided with a TPU lining layer 15, too. The waterproof zipper 13 and the peripheral portion 12 are connected together by a laminator through a hot pressing process.

Figure 5:
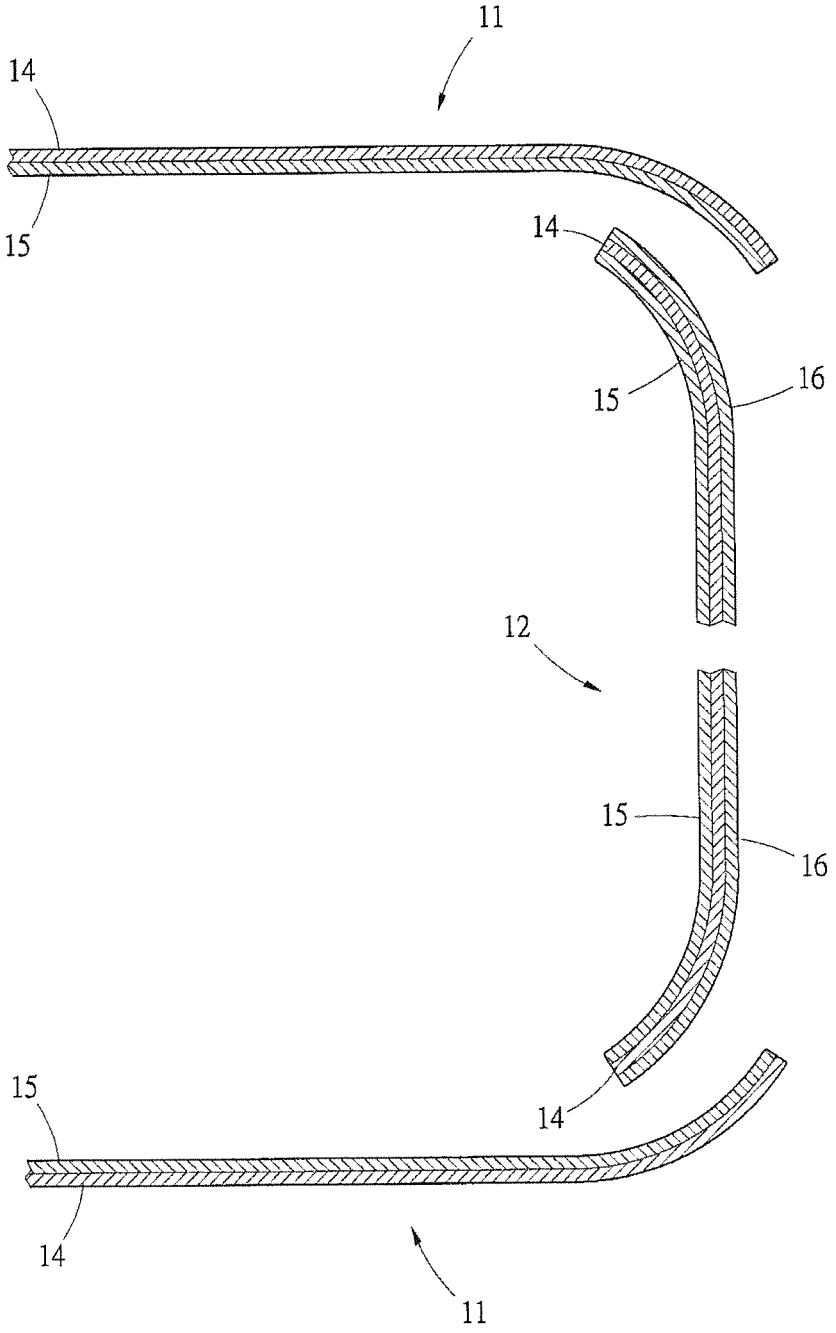
FIG. 5 schematically shows the connecting areas of the central portions and of the peripheral portion of the mattress protector in FIG. 1.

Manufacture of the mattress protector 10 begins by placing one of the central portions 11 at the upper end of the peripheral portion 12 and the other central portion 11 at the lower end of the peripheral portion 12, as shown in FIG. 2 and FIG. 5. Then, the contact areas of the two central portions 11 and of the peripheral portion 12 are connected together by a laminator through a hot pressing process to form the hollow mattress protector 10 as shown in FIG. 1.

The peripheral portion 12 and the upper and lower central portions 11 have a low elongation rate and high tensile strength and feel comfortable to the touch, thanks to their woven-fabric base layers 14.

The TPU lining layers 15 on the inner sides of the upper and lower central portions 11 and of the peripheral portion 12 are fused together by the hot pressing used to connect the aforesaid contact areas such that a sealed and gap-free inner structure is formed inside the mattress protector 10 to provide waterproofness and prevent seepage.

Once the waterproof zipper 13 is opened, a mattress can be put into the mattress protector 10, allowing the sealed and gap-free inner structure formed by the TPU lining layers 15 to enclose the mattress and block liquids from seeping to the mattress.

The mattress protector 10 can be removed from the mattress in order to be cleaned. After that, the mattress protector 10 can be used again.

When manufacturing the mattress protector 10 of the present invention, there are no limitations on the type and specifications of the woven-fabric base layers 14 of the peripheral portion 12 and of the upper and lower central portions 11. All well-known woven fabrics such as nylon fabrics and other synthetic fiber-woven fabrics can be used, provided that the fabric in use can be connected to the TPU lining layers 15 by a laminator through a hot pressing process.

According to the above, the present invention is indeed capable of achieving the intended objective. Moreover, a detailed description has been given to enable a person of ordinary skill in the art to implement the invention. It is understood, however, that the embodiment provided herein serves illustrative purposes only. All changes with equivalent structures and all modifications which do not depart from the principle of the present invention should fall within the scope of the appended claims.

What is claimed is:

1. A mattress protector, comprising:

an upper central portion and a lower central portion, each of said upper and lower central portions defining a flexible and substantially flat planar structure, each of said upper and lower central portions defining a contact area, each of said upper and lower central portions having a first laminated structure including a woven-fabric outer layer and a TPU (thermoplastic polyurethane) lining layer laminated to an inner side of the woven-fabric base layer, wherein the woven-fabric outer layer and the TPU lining layer are connected together by a laminator through a hot pressing process; and a peripheral portion having a second laminated structure different from the first laminated structure, the peripheral portion including a woven-fabric internal layer sandwiched between a TPU lining layer laminated to an inner side of the woven-fabric internal layer of the peripheral portion, and a PU (polyurethane) shell layer laminated to an outer side of the woven-fabric internal layer of the peripheral portion, wherein the woven-fabric internal layer, the TPU lining layer, and the PU shell layer of the peripheral portion are connected together by a laminator through a hot pressing process, the peripheral portion further having a middle section provided with a slit selectively closed by a waterproof zipper;

wherein the upper central portion and the lower central portion are placed above and below the peripheral portion respectively, and the contact areas of the upper and lower central portions and an upper end and a lower end of the peripheral portion are connected together by a laminator through a hot pressing process such that the TPU lining layers on the inner sides of the upper and lower central portions and of the peripheral portion are fused together by the hot pressing process used to connect said contact areas and form a sealed and gap-free inner structure inside the mattress protector.

2. The mattress protector of claim 1, wherein the waterproof zipper on the peripheral portion has two sides which can be opened with respect to each other and a zipper TPU lining layer is laminated to an outer surface of the waterproof zipper, and the waterproof zipper is connected to the peripheral portion by a laminator through a hot pressing process to capture the waterproof zipper between the TPU lining layer of the peripheral portion and the zipper TPU lining layer.

* * * * *